US006734364B2

(12) United States Patent
Price et al.

(10) Patent No.: US 6,734,364 B2
(45) Date of Patent: May 11, 2004

(54) CONNECTING WEB FOR CABLE APPLICATIONS

(75) Inventors: David M. Price, Charlotte, NC (US); Joseph S. Elko, Hickory, NC (US); Ricky D. Rathbone, Catawba, NC (US)

(73) Assignee: Commscope Properties LLC, Sparks, NV (US)

( * ) Notice: Subject to any disclaimer, the term of this patent is extended or adjusted under 35 U.S.C. 154(b) by 0 days.

(21) Appl. No.: 10/081,871

(22) Filed: Feb. 20, 2002

(65) Prior Publication Data

US 2002/0125036 A1 Sep. 12, 2002

Related U.S. Application Data

(60) Provisional application No. 60/270,933, filed on Feb. 23, 2001.

(51) Int. Cl.[7] ..... H01B 7/08

(52) U.S. Cl. ..... 174/117 F; 174/113 R; 174/113 C

(58) Field of Search ..... 174/113 R, 117 F, 174/115, 113 C, 114 R

(56) References Cited

U.S. PATENT DOCUMENTS

| | | | | |
|---|---|---|---|---|
| 2,666,093 A | | 1/1954 | Wildberg | |
| 2,701,819 A | | 2/1955 | Hirtle | |
| 3,361,871 A | | 1/1968 | Brandt | |
| 3,502,791 A | | 3/1970 | Dahlstrom | |
| 3,696,412 A | | 10/1972 | Swanson | |
| 4,230,898 A | * | 10/1980 | Emmel | 174/32 |
| 4,460,676 A | * | 7/1984 | Fabel | 430/333 |
| 4,467,138 A | | 8/1984 | Brorein | |
| 4,638,117 A | | 1/1987 | Ney | |
| 4,729,628 A | | 3/1988 | Kraft et al. | |
| 4,783,578 A | | 11/1988 | Bodensiek et al. | |
| 4,857,010 A | | 8/1989 | Ponn | |
| 4,952,020 A | | 8/1990 | Huber | |
| 5,180,890 A | | 1/1993 | Pendergrass et al. | |
| 5,189,718 A | | 2/1993 | Barrett et al. | |
| 5,286,924 A | | 2/1994 | Loder et al. | |
| 5,342,991 A | | 8/1994 | Xu et al. | |
| 5,371,823 A | | 12/1994 | Barrett et al. | |
| 5,486,654 A | | 1/1996 | Hanak et al. | |
| 5,561,903 A | | 10/1996 | Bourbeau | |
| 5,606,151 A | * | 2/1997 | Siekierka et al. | 174/113 R |
| 5,750,932 A | | 5/1998 | Hansson | |
| 5,789,711 A | * | 8/1998 | Gaeris et al. | 174/113 C |
| 6,131,289 A | | 10/2000 | Tarpill | |
| 6,188,821 B1 | | 2/2001 | McAlpine et al. | |
| 6,188,822 B1 | | 2/2001 | McAlpine et al. | |

FOREIGN PATENT DOCUMENTS

| | | |
|---|---|---|
| DE | 3527847 A1 | 2/1987 |
| EP | 123-417 | 10/1984 |
| GB | 625 051 A | 6/1949 |
| IT | 517745 | 3/1955 |
| JP | 6-131920 | 5/1994 |

OTHER PUBLICATIONS

International Search Report from corresponding International Application No. PCT/US02/05263, dated Sep. 12, 2002.

* cited by examiner

*Primary Examiner*—Chau N. Nguyen
(74) *Attorney, Agent, or Firm*—Alston & Bird LLP

(57) ABSTRACT

The present invention is a connecting web for side-by-side cables that eliminates the need for the use of slitting tools. The present invention includes a first elongate cable, a second elongate cable in parallel spaced apart relation from said first elongate cable and a connecting web between the first elongate cable and the second elongate cable. The connecting web is connected to the first elongate cable along a first surface and to the second elongate cable along a second surface and is capable of being pulled away from the first elongate cable or the second elongate cable without leaving a residue of the connecting web on either cable that will prevent a connector or bulkhead grommet from properly sealing around the cables. Thus, the connecting web can be removed without damaging the cables to provide good connectorization between the side-by-side cables and other cables.

18 Claims, 2 Drawing Sheets

CONNECTING WEB FOR CABLE APPLICATIONS

CROSS-REFERENCE TO RELATED APPLICATIONS

This application is related to commonly owned copending provisional application Serial No. 60/270,933, filed Feb. 23, 2001, and claims the benefit of the earlier filing date of this application under 35 U.S.C. § 119(e).

FIELD OF THE INVENTION

The present invention relates to connecting webs for cable applications and more particularly, to connecting webs for connecting side-by-side cables that can be readily removed from the side-by-side cables without leaving a residue on the cables that will prevent a connector or bulkhead grommet from properly sealing around the cable.

BACKGROUND OF THE INVENTION

Coaxial cables are widely used in many different applications such as the distribution of video signals. In most situations, a single coaxial cable is sufficient to carry the necessary signals. However, there are many other applications where multiple cables are needed and the cable manufacturing industry has provided various types of multiple cable assemblies to meet these needs.

For example, coaxial cable may be provided with an attached support wire or messenger wire. Often, the messenger wire is positioned adjacent to and parallel with the coaxial cable with both cables being encased in thermoplastic insulating coatings. The two insulated cables are connected together by a web of the same thermoplastic insulating material forming an integral side-by-side coaxial cable and messenger wire support.

In other applications, pairs or triples of coaxial cable may be desired for redundancy or to increase signal carrying capacity. Multiple cable designs may also have twisted pair or multi-strand control wires placed adjacent to coaxial cables. Messenger wire supports may be added to these dual and triple cable designs. In each of these designs, the cables are held in a side-by-side relationship by a web usually formed out of the same material used to provide the outer cable insulation layer.

To use such cables, the web must be severed for some distance back from the end of the cable to free the cable for connection to an end point. Often, the web is designed to be quite weak, allowing the adjacent cables to be pulled apart. However, this technique can result in damaging the insulating coating on one or more of the cables. In addition, the web material is not completely removed from one or more of the cables.

A slitting tool can alternatively be used to separate the web between the cables. However, it is difficult to fully remove the web and a ridge of excess web material can remain on the cable. For coaxial cables, in particular, this ridge can interfere with proper attachment of an electrical connector. Coaxial connectors are usually designed for use with coaxial cables having a circular defect-free cross section. The excess web material left with prior slitting techniques produces a protrusion on the cross section that may prevent the cable from properly seating completely in the connector or a bulkhead grommet. Alternatively, the ridge may prevent the connector sleeve from properly sealing around the cable when the connector is crimped. In addition, the ridge of excess web material often provides a migration path for water, which can result in corrosion of the cable.

One solution to this problem has been to improve slitting tool technology such as is described in U.S. Pat. No. 6,131,289 to limit the existence of residue. However, there is a need in the art to provide a method of separating cables that does not require a slitting tool. Another solution to the problem has been to provide a web that remains on only one of the side-by-side cables. However, the connectorization and grommet fitting issues still exist with respect to the other side-by-side cable.

SUMMARY OF THE INVENTION

The present invention provides a connecting web for side-by-side cables that eliminates the need for the use of slitting tools. The connecting web can be pulled away from the side-by-side cables without leaving a residue on either of the cables that will prevent a connector or bulkhead grommet from properly sealing around the cables. The connecting web of the invention also allows an end user to pull in several cables at once and then pull away the connecting web so that the finished product still includes individual sets of cable.

The present invention includes a first elongate cable, a second elongate cable in parallel spaced apart relation from said first elongate cable and a connecting web between the first elongate cable and the second elongate cable. The connecting web is connected to the first elongate cable along a first surface and to the second elongate cable along a second surface and is preferably capable of being removed from the first elongate cable and the second elongate cable without leaving a residue of the connecting web on either cable that will prevent a connector or bulkhead grommet from properly sealing around the first elongate cable or the second elongate cable. Preferably, the connecting web is capable of being detached from the first elongate cable and/or the second elongate by pulling away the connecting web. The communications cable can also include more than two elongate cables with each elongate cable connected to at least one other elongate cable through the use of the connecting web. The first elongate cable and the second elongate cable typically each include one or more cables selected from the group consisting of coaxial cables, fiber optic cables, twisted pair cables, electrical cables and support cables. In addition, at least one of the first elongate cable and the second elongate cable can include one or more cables within a cable jacket with the connecting web attached to the cable jacket.

In one embodiment of the invention, the connecting web has a longitudinal cross-section that is generally diamond-shaped. In addition or alternatively, the connecting web can include a strengthening member oriented generally along a central longitudinal axis of the connecting web such as a cotton or polyester yarn. The connecting web can further or alternatively include a plurality of perforations along the first surface between the first cable and the connecting web and along the second surface between the second cable and the connecting web to facilitate removal of the connecting web from the first elongate cable and the second elongate cable. The connecting web preferably has a width of at least 0.05 inches and more preferably from about 0.06 inches to about 0.5 inches. In addition, at a intermediate location on a lateral axis between the first surface and the second surface, the lateral cross-sectional area of the connecting web is preferably greater than the lateral cross-sectional area of the connecting web at the first surface and at the second surface. Moreover, the lateral cross-sectional area of the connecting web preferably increases from the first surface to a central longitudinal axis of the connecting web and from the second surface to the central longitudinal axis.

These and other features and advantages of the present invention will become more readily apparent to those skilled in the art upon consideration of the following detailed description and accompanying drawings, which describe both the preferred and alternative embodiments of the present invention.

DETAILED DESCRIPTION OF THE PREFERRED EMBODIMENTS

Figure 1:
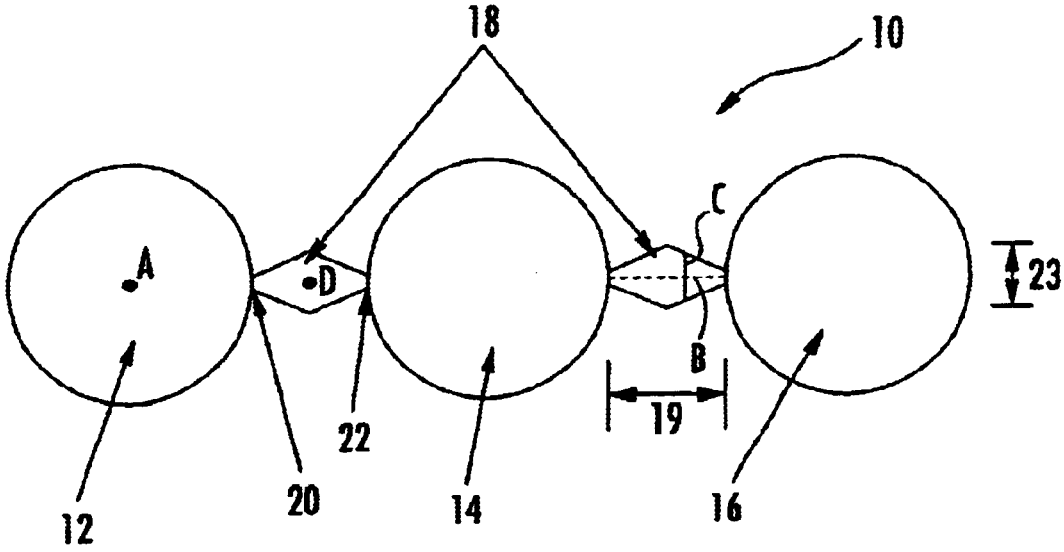
FIG. 1 is a cross-sectional view of one embodiment of the invention wherein a connecting web having a generally diamond-shaped cross-section is used to connect side-by-side cables.

In the drawings and the following detailed description, preferred embodiments are described in detail to enable practice of the invention. Although the invention is described with reference to these specific preferred embodiments, it will be understood that the invention is not limited to these preferred embodiments. But to the contrary, the invention includes numerous alternatives, modifications and equivalents as will become apparent from consideration of the following detailed description and accompanying drawings. In the drawings, like numbers refer to like elements throughout.

FIG. 1 illustrates a communications cable 10 according to a first embodiment of the invention. The communications cable 10 includes a plurality of elongate cables. For example, FIG. 1 includes three elongate cables 12, 14 and 16. The elongate cables 12, 14 and 16 extend longitudinally along a longitudinal axis (as illustrated by point A in cable 12) that extends along the length of the cable. Although FIG. 1 illustrates the use of three cables, any configuration of two or more cables can be used in accordance with the invention.

As shown in FIG. 1, adjacent cables (e.g. cables 12 and 14 or cables 14 and 16) are in parallel spaced apart relation in a side-by-side relationship. In this embodiment and in the other embodiments of the invention, the elongate cables can represent either a single cable (e.g. a coaxial cable) or can include a plurality of cables provided within a cable jacket. The elongate cables can be coaxial cables, fiber optic cables, twisted pair cables, electrical cables, support or messenger cables, and the like. Suitable cables are described, for example, in coassigned U.S. Pat. Nos. 6,139,957; 6,137,058; 6,064,008; 6,037,545; 5,969,295; 5,959,245; 5,949,018; 5,926,949; 5,814,768; 5,777,271; 5,719,353; 5,651,081; 5,614,319; 5,560,536; 5,542,020; 5,469,523; 5,462,803; 5,448,670; 5,345,526; 5,293,678; 5,254,188; 5,042,904; 4,894,488; 4,701,575; 4,691,081; 4,515,992; 4,484,023; 4,472,595; 4,107,354; and 4,104,481, and coassigned pending U.S. patent application Ser. Nos. 09/019,417; 09/070,789; 09/326,049; 09/485,656; 09/552,903; 09/577,997; 09/598,508; 09/603,818; and 09/939,956, all of which are hereby incorporated by reference in their entirety. In one preferred embodiment of the invention, the first elongate cable is a coaxial cable (e.g. a drop cable) and the second elongate cable includes two twisted pair cables.

In accordance with the invention, adjacent cables (e.g. cables 12 and 14 or cables 14 and 16 in FIG. 1) are attached to one another through the use of a connecting web 18. In particular, as shown in FIG. 1, the connecting web 18 connects to cable 12 along a first surface 20 and to cable 14 along a second surface 22. The connecting web in this embodiment and in the other embodiments of the invention can be formed of any suitable thermoplastic material including but not limited to linear low density polyethylene (LLDPE), medium density polyethylene (MDPE), high density polyethylene (HDPE), low density polyethylene (LDPE), polyvinyl chloride (PVC), and mixtures thereof. Preferably, the connecting web 18 is formed of the same material that is used to form the cable jacket(s) for the side-by-side cables. The connecting web 18 preferably has a width 19 of at least 0.05 inches and more preferably from about 0.06 to about 0.5 inches. For example, for drop cable, the width 19 is preferably from about 0.06 inches to about 0.09 inches.

As shown in FIG. 1, the connecting web 18 preferably increases in cross-sectional area in a lateral direction from the first surface 20 and the second surface 22 to an intermediate location (e.g. C) on a lateral axis B between the first surface and the second surface. Stated differently, the lateral cross-sectional area of the connecting web 18 at an intermediate location C is greater than the lateral cross-sectional area of the connecting web along said first surface 20 and along said second surface 22. It has been discovered that when the cross-sectional areas of the surfaces adjacent the cable (e.g. first and second surfaces 20 and 22) are smaller than at an intermediate location along the connecting web 18 that the connecting web 18 is capable of being readily detached from the cables by applying pressure (i.e. force) to the connecting web. Furthermore, because the cross-sectional area is relatively small where the connecting web 18 connects to the cables, the connecting web 18 can be removed without leaving a residue of the connecting web on either cable that will prevent a connector or bulkhead grommet from properly sealing around the cable. In other words, when the connecting web 18 is removed, the cables are free of a residue that will prevent a connector or bulkhead grommet from properly sealing around the cable. Typically, there is either no residue or a negligible amount (e.g. less than or equal to about 5 mils) of residue on the cables once the connecting web 18 is removed thereby allowing a connector or bulkhead grommet to properly seal around the cable.

Preferably, as illustrated in FIG. 1, the connecting web 18 includes a central longitudinal axis (as illustrated by point D) and the lateral cross-sectional area of the web increases from the first surface 20 to the center axis and from the second surface 22 to the central axis. The thickness 23 or cross-sectional height of the connecting web 18 along the central axis is preferably at least 0.025 inches (e.g. from 0.025 to 0.25 inches) and more preferably from about 0.03 to about 0.1 inches. For example, for drop cable, the thickness 23 is preferably from about 0.03 to about 0.035 inches. The thickness of the connecting web 18 along the first and second surfaces 20 and 22, on the other hand, is preferably from about 0.005 to about 0.012 inches. As illustrated in FIG. 1, the connecting web 18 preferably has a longitudinal cross-section that is generally diamond-shaped.

Figure 2:
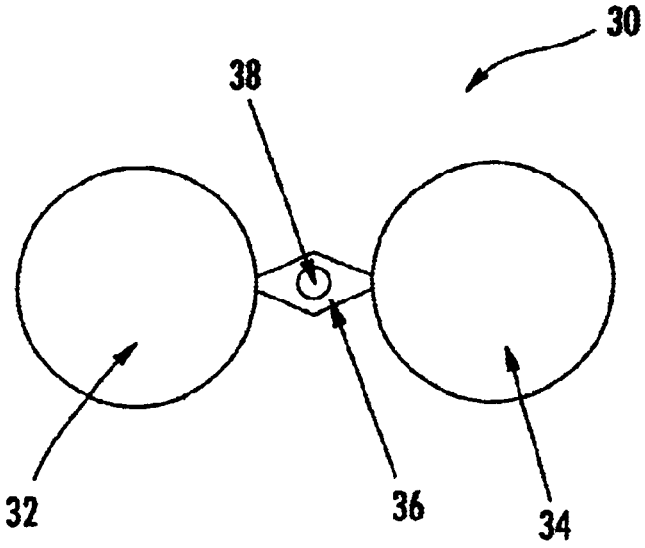
FIG. 2 is a cross-sectional view of one embodiment of the invention wherein a connecting web having a generally diamond-shaped cross-section and a strengthening member is used to connect side-by-side cables.

FIG. 2 illustrates an alternative embodiment of the invention wherein a communications cable 30 includes a first elongate cable 32 and a second elongate cable 34 in a side-by-side relationship and attached to one another through the use of a connecting web 36. The communications cable 30 in FIG. 2 differs from the communications cable 10 illustrated in FIG. 1 in that the communications cable 30 includes a strengthening member 38 oriented generally along a central axis of the connecting web 36. The strengthening member 38 provides a pulling point for the connecting web 36 to aid in the removal of the connecting web from the cables 32 and 34. The strengthening member 38 can be formed of any suitable material such as a yarn material. Cotton and polyester yarns are particularly useful for use as the strengthening member 38.

The communications cable 10 and 30 illustrated in FIGS. 1 and 2 can be manufactured by advancing two or more cables (e.g. 32 and 34) in parallel spaced apart relation in a side-by-side relationship through an extruder mounted crosshead. The thermoplastic materials listed above for use as the connecting web material are fed to the extruder and heated to form a polymer melt. As the cables are advanced through the crosshead, the polymer melt is extruded over the cables. When a strengthening member 38 is used, it is positioned between the cables as they are advanced to the crosshead and the polymer melt is extruded over the cables and the strengthening member. A die is used to form the polymer melt into a connecting web 36 with a desired shape (i.e. cross-section) such as a diamond shape as it passes through the crosshead. The polymer melt then cools to form the connecting web 36, which connects the side-by-side cables to form the communications cable 10 and 30 of FIGS. 1 and 2.

Figure 3:
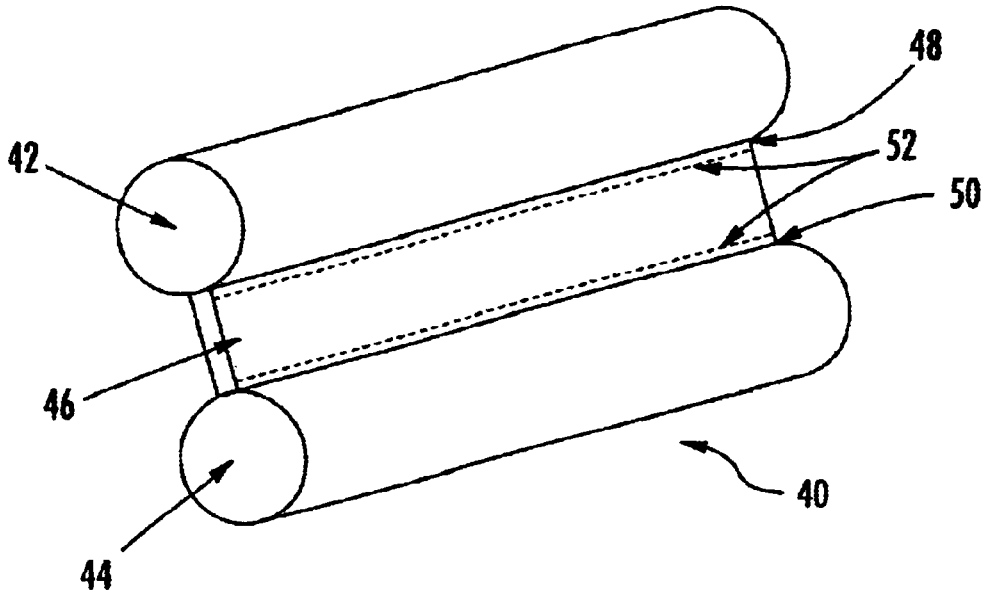
FIG. 3 is a perspective view of one embodiment of the invention wherein a connecting web having a plurality of perforations is used to connect side-by-side cables.
Figure 4:
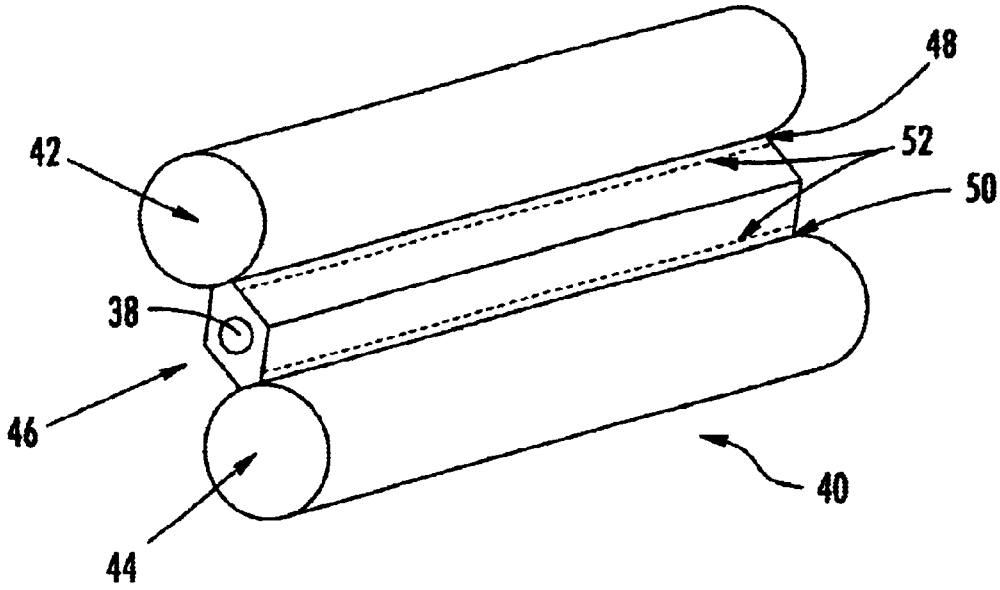
FIG. 4 is a perspective view of one embodiment of the invention wherein a connecting web having a generally diamond-shaped cross section, a strengthening member and plurality of perforations is used to connect side-by-side cables.

FIG. 3 illustrates another embodiment of the invention. In FIG. 3, the communications cable 40 includes a first elongate cable 42 and a second elongate cable 44 in a side-by-side relationship and attached by a connecting web 46. As illustrated in FIG. 3, the connecting web 46 connects to the first elongate cable 42 along a first surface 48 and connects to the second elongate cable 44 along a second surface 50. The connecting web 46 includes a plurality of perforations 52 along both the first surface 48 and the second surface 50. The perforations 52 can be in the form of holes or slits in the connecting web 46. The perforations 52 shown in FIG. 3 are spaced from the first surface 48 and the second surface 50 for illustration purposes only because it would be difficult to view the perforations otherwise in the figure. In actual use, the perforations 52 are provided directly along the first surface 48 and second surface 50 so that when the connecting web 46 is removed by pulling on the connecting web, there is no residue of the connecting web 46 remaining on the surface of the cables 42 and 44. The connecting web 46 is provided having a substantially constant cross-section from said first surface 48 to said second surface 50 in FIG. 3 but can have a varying cross section, e.g., a cross section that increases in area from the first and second surfaces to a central axis as described in FIGS. 1 and 2 above. In addition, as shown in FIG. 4, the connecting web 46 can be generally diamond-shaped and can include a strengthening member 38 to aid in pulling the connecting web from the cables 42 and 44.

The communications cable 40 illustrated in FIG. 3 can be manufactured by advancing two or more cables (e.g. 42 and 44) in parallel spaced apart relation in a side-by-side relationship through an extruder mounted crosshead. The thermoplastic materials listed above for use as the connecting web material are fed to the extruder and heated to form a polymer melt. As the cables are advanced through the crosshead, the polymer melt is extruded over the cables. A die is used to form the polymer melt into a connecting web with a desired shape (i.e. cross-section) such as a diamond shape as it passes through the crosshead. The polymer melt then cools to form the connecting web 46, which connects the side-by-side cables to form the communications cable 40 of FIG. 3. A small set of wheels with teeth such as a spur set can then be rolled along the connecting web 46 to form the perforations 52. Although not required, the connecting web 46 can be supported on one side while applying the spur set on the other side to facilitate the formation of the perforations 52.

The present invention provides a connecting web 18 for side-by-side cables (e.g. 12, 14 and 16) that can be manually removed thus eliminating the need for slitting tools. In particular, two side-by-side cables can be separated by manually pulling them apart resulting in the separation of the connecting web 18 from one of the cables. The connecting web 18 can then be manually pulled away from the other cable. Alternatively, the connecting web 18 can be pulled away from both cables simultaneously by applying a force to the connecting web 18. The connecting web 18 is preferably pulled away at a pull-away rate from a cable using a force that is at least sufficient to separate the connecting web 18 from the cable but that is not so great as to exceed the tensile strength and thus the elastic limit of the material being used in the connecting web. For example, the connecting web 18 can be pulled away from a cable at a rate of about 10 inches per minute by applying a force of from 0.5 and 1.5 pounds to the connecting web. In particular, in one embodiment of the invention wherein the connecting web 18 is diamond shaped and formed of LLDPE, the connecting web has a tensile strength of 1.8 pounds force and a force of at least 0.5 pounds is sufficient to remove the connecting web 18 from the cable.

As mentioned above, the connecting web 18 does not leave a residue on either of the side-by-side cables that will prevent a connector or bulkhead grommet from properly sealing around the cable. Thus, using the connecting web 18 of the present invention facilitates good connectorization between the side-by-side cables and other cables. Moreover, the connecting web provides a method of separating cables without damaging the cables during removal of the connecting web. The connecting web of the invention also allows an end user to pull in several cables at once and then pull away the connecting web so that the finished product still includes individual sets of cable as is desirable in the art.

It is understood that upon reading the above description of the present invention and reviewing the accompanying drawings, one skilled in the art could make changes and variations therefrom. These changes and variations are included in the spirit and scope of the following appended claims.

That which is claimed:

1. A communications cable, comprising:

a first elongate cable;

a second elongate cable in parallel spaced apart relation from said first elongate cable; and a connecting web having a longitudinal cross-section that is generally diamond-shaped between said first elongate cable and said second elongate cable and connected to said first elongate cable and said second elongate cable.

2. The communications cable according to claim 1, wherein said connecting web is capable of being removed from said first elongate cable and said second elongate cable without leaving a residue of the connecting web on said first elongate cable or said second elongate cable that will prevent connectors from properly sealing around said first elongate cable and said second elongate cable.

3. The communications cable according to claim 1, wherein said connecting web further comprises a strengthening member oriented generally along a central longitudinal axis of the connecting web.

4. The communications cable according to claim 1, wherein said connecting web connects to said first elongate cable along a first surface and to said second elongate cable along a second surface and includes a plurality of perforations along said first surface and along said second surface.

5. The communications cable according to claim 1, wherein the connecting web is capable of being detached from said first elongate cable or said second elongate by pulling away the connecting web.

6. The communications cable according to claim 1, comprising more than two elongate cables, each elongate cable connected to at least one other elongate cable through the use of said connecting web.

7. A communications cable, comprising:

a first elongate cable;

a second elongate cable in parallel spaced apart relation from said first elongate cable; and a connecting web between said first elongate cable and said second elongate cable and connected to said first elongate cable along a first surface and connected to said second elongate cable along a second surface, said connecting web having a plurality of perforations along said first surface and along said second surface.

8. The communications cable according to claim 7, wherein said connecting web is capable of being removed from said first elongate cable and said second elongate cable without leaving a residue of the connecting web on said first elongate cable or said second elongate cable that will prevent connectors from properly sealing around said first elongate cable and said second elongate cable.

9. The communications cable according to claim 7, having a substantially constant lateral cross-sectional area from said first surface to said second surface.

10. The communications cable according to claim 7, wherein at a intermediate location at a lateral axis between said first surface and said second surface, the lateral cross-sectional area of said web is greater than the lateral cross-sectional area of the web at said first surface and said second surface.

11. The communications cable according to claim 7, wherein said connecting web further comprises a strengthening member oriented generally along a central longitudinal axis of the connecting web.

12. The communications cable according to claim 7, wherein the connecting web is capable of being detached from said first elongate cable or said second elongate by pulling away the connecting web.

13. The communications cable according to claim 7, comprising more than two elongate cables, each elongate cable connected to at least one other elongate cable through the use of said connecting web.

14. A communications cable, comprising:

a first elongate cable;

a second elongate cable in parallel spaced apart relation from said first elongate cable; and a connecting web having a strengthening member oriented generally along a central longitudinal axis of the connecting web, said connecting web between said first elongate cable and said second elongate cable and connected to said first elongate cable and said second elongate cable.

15. The communications cable according to claim 14, wherein said connecting web is capable of being removed from said first elongate cable and said second elongate cable without leaving a residue of the connecting web on said first elongate cable or said second elongate cable that will prevent connectors from properly sealing around said first elongate cable and said second elongate cable.

16. The communications cable according to claim 14, wherein said strengthening member is a cotton or polyester yarn.

17. The communications cable according to claim 14, wherein the connecting web is capable of being detached from said first elongate cable or said second elongate by pulling away the connecting web.

18. The communications cable according to claim 14, comprising more than two elongate cables, each elongate cable connected to at least one other elongate cable through the use of said connecting web.

* * * * *